US011142424B2

(12) United States Patent
Kakuta et al.

(10) Patent No.: US 11,142,424 B2
(45) Date of Patent: Oct. 12, 2021

(54) SHEET CONVEYING APPARATUS AND IMAGE FORMING SYSTEM INCLUDING SAME

(71) Applicant: KYOCERA Document Solutions Inc., Osaka (JP)

(72) Inventors: Masayuki Kakuta, Osaka (JP); Sachio Izumichi, Osaka (JP); Risa Hibino, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 48 days.

(21) Appl. No.: 16/840,056

(22) Filed: Apr. 3, 2020

(65) Prior Publication Data

US 2020/0317460 A1 Oct. 8, 2020

(30) Foreign Application Priority Data

Apr. 5, 2019 (JP) ..... JP2019-072430

(51) Int. Cl.
*B65H 29/12* (2006.01)
*B65H 29/58* (2006.01)
*B41J 13/00* (2006.01)

(52) U.S. Cl.
CPC ..... *B65H 29/58* (2013.01); *B41J 13/0009* (2013.01); *B65H 29/125* (2013.01); *B65H 2301/33* (2013.01); *B65H 2801/06* (2013.01)

(58) Field of Classification Search
CPC .. B65H 29/58; B65H 29/125; B65H 2801/06; B65H 2301/33; B65H 9/106; B65H 2511/22; B65H 2301/4452; B65H 2404/1422; B65H 9/103; B65H 85/00; B65H 2513/42; B65H 2511/13; B65H 29/60; B65H 43/00; B41J 13/0009
See application file for complete search history.

(56) References Cited

U.S. PATENT DOCUMENTS

| | | | | |
|---|---|---|---|---|
| 9,682,834 | B2 * | 6/2017 | Kodama | B65H 29/58 |
| 9,925,763 | B2 * | 3/2018 | Kodama | B65H 29/125 |
| 2017/0210122 | A1 | 7/2017 | Kodama et al. | 2/57 |
| 2018/0194130 | A1 | 7/2018 | Kodama et al. | 2/57 |

FOREIGN PATENT DOCUMENTS

JP 2017-132636 A 8/2017

* cited by examiner

*Primary Examiner* — Huan H Tran
(74) *Attorney, Agent, or Firm* — Stein IP, LLC

(57) ABSTRACT

A sheet conveying apparatus includes a sheet conveying path, conveying members, a switching unit, a receiving unit, and a control unit. The sheet conveying path includes a first conveying path and a second conveying path having a conveying load for a sheet larger than the first conveying path. The switching unit selectively switches the sheet conveying path between the first conveying path and the second conveying path. The control unit determines whether the sheets are first sheets or second sheets thicker than the first sheets, based on sheet thickness information received by the receiving unit. If the sheets are the first sheets, the switching unit switches the sheet conveying path between the first conveying path and the second conveying path alternately. If the sheets are the second sheets, the switching unit switches to fix the sheet conveying path to the first conveying path.

8 Claims, 7 Drawing Sheets

SHEET CONVEYING APPARATUS AND IMAGE FORMING SYSTEM INCLUDING SAME

INCORPORATION BY REFERENCE

This application is based upon and claims the benefit of priority from the corresponding Japanese Patent Application No. 2019-072430 filed Apr. 5, 2019, the entire contents of which are hereby incorporated by reference.

BACKGROUND

The present disclosure relates to a sheet conveying apparatus that conveys sheets and an image forming system including the same.

Conventionally, there is known a sheet post-processing apparatus, which can stuck a plurality of paper sheets on which images are formed by an image forming apparatus such as a copier or a printer, and can perform a binding process of stapling a bundle of the stacked paper sheets, a punch hole forming process of forming holes with a punch hole forming device, and other process. When performing a post-processing such as the binding process on a relatively large amount of paper sheets, the sheet post-processing apparatus described above is used.

As a method of connecting the image forming apparatus and the sheet post-processing apparatus, there is proposed a method of disposing an intermediate conveying apparatus between the image forming apparatus and the sheet post-processing apparatus. For instance, there is known an intermediate conveying apparatus including a conveying unit that conveys a medium along a conveying path from an upstream side to a downstream side in a conveying direction, a printing unit that performs printing by applying liquid onto the medium conveyed by the conveying unit, a first reversing unit and a second reversing unit that are disposed on the downstream side of the printing unit in the conveying direction so as to reverse the medium conveyed by the conveying unit, a pre-reverse path disposed on the upstream side of the first reversing unit and the second reversing unit in the conveying direction, and a post-reverse path disposed on the downstream side of the first reversing unit and the second reversing unit in the conveying direction.

SUMMARY

A sheet conveying apparatus according to one aspect of the present disclosure includes a sheet conveying path, conveying members, a switching unit, a receiving unit, and a control unit. The sheet conveying path includes a first conveying path and a second conveying path that is disposed in parallel to each other. The second conveying path has a conveying load for a sheet larger than the first conveying path. The conveying members are disposed along the sheet conveying path so as to convey the sheet. The switching unit is disposed at a branch part of the first conveying path and the second conveying path so as to selectively switch the sheet conveying path between the first conveying path and the second conveying path. The receiving unit receives sheet thickness information. The control unit controls the conveying members and the switching unit on the basis of the sheet thickness information. The control unit determines whether the sheet is a first sheet or a second sheet thicker than the first sheet on the basis of the sheet thickness information. When conveying the first sheets, the control unit controls the switching unit to switch the sheet conveying path between the first conveying path and the second conveying path alternately for every sheet. When conveying the second sheets, the control unit controls the switching unit to fix the sheet conveying path to the first conveying path.

Other objects of the present disclosure and specific advantages obtained by the present disclosure will become more apparent from the description of the embodiment given below.

DETAILED DESCRIPTION

Figure 1:
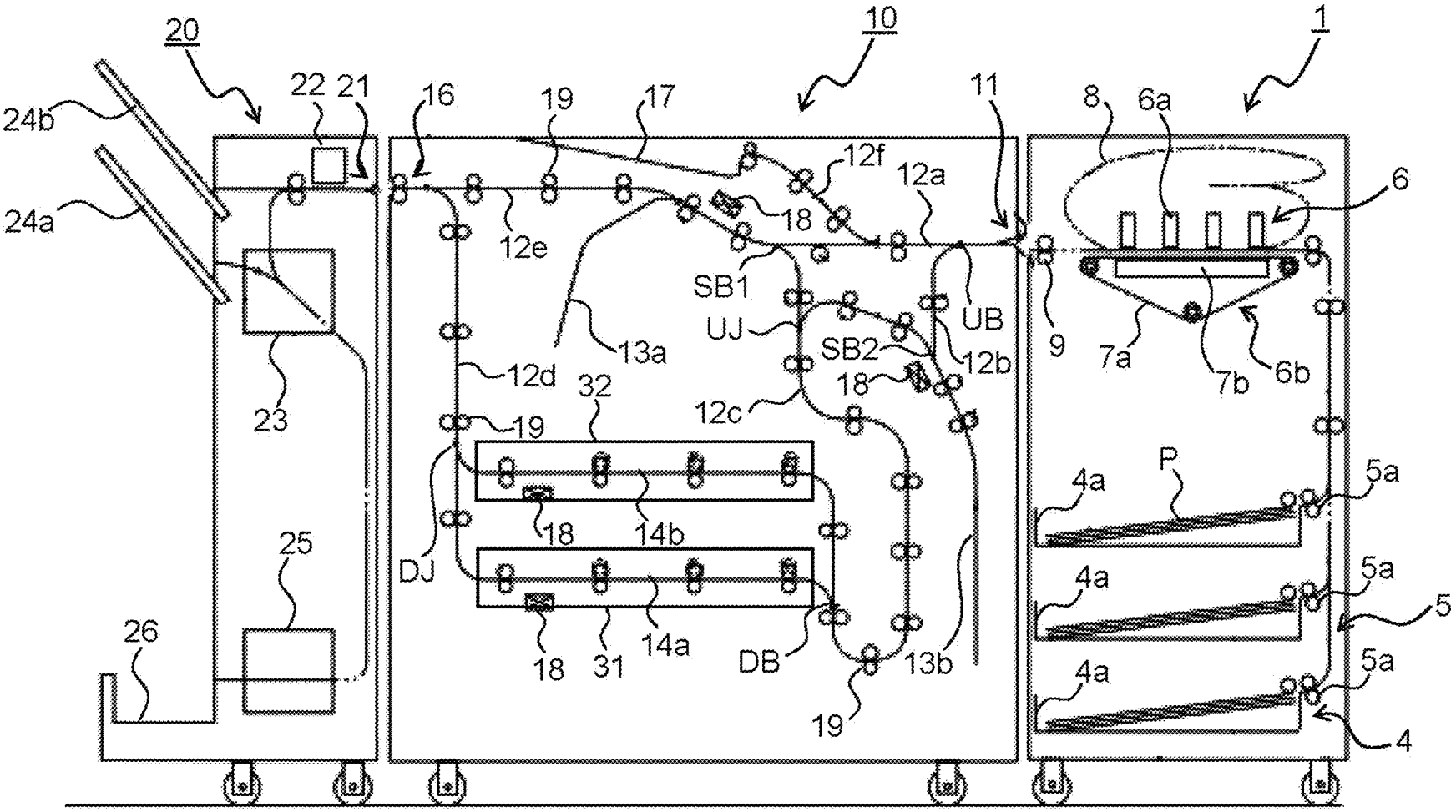
FIG. 1 is a schematic drawing illustrating an internal structure of an image forming apparatus, a relay conveying apparatus, and a sheet post-processing apparatus constituting an image forming system.
Figure 2:
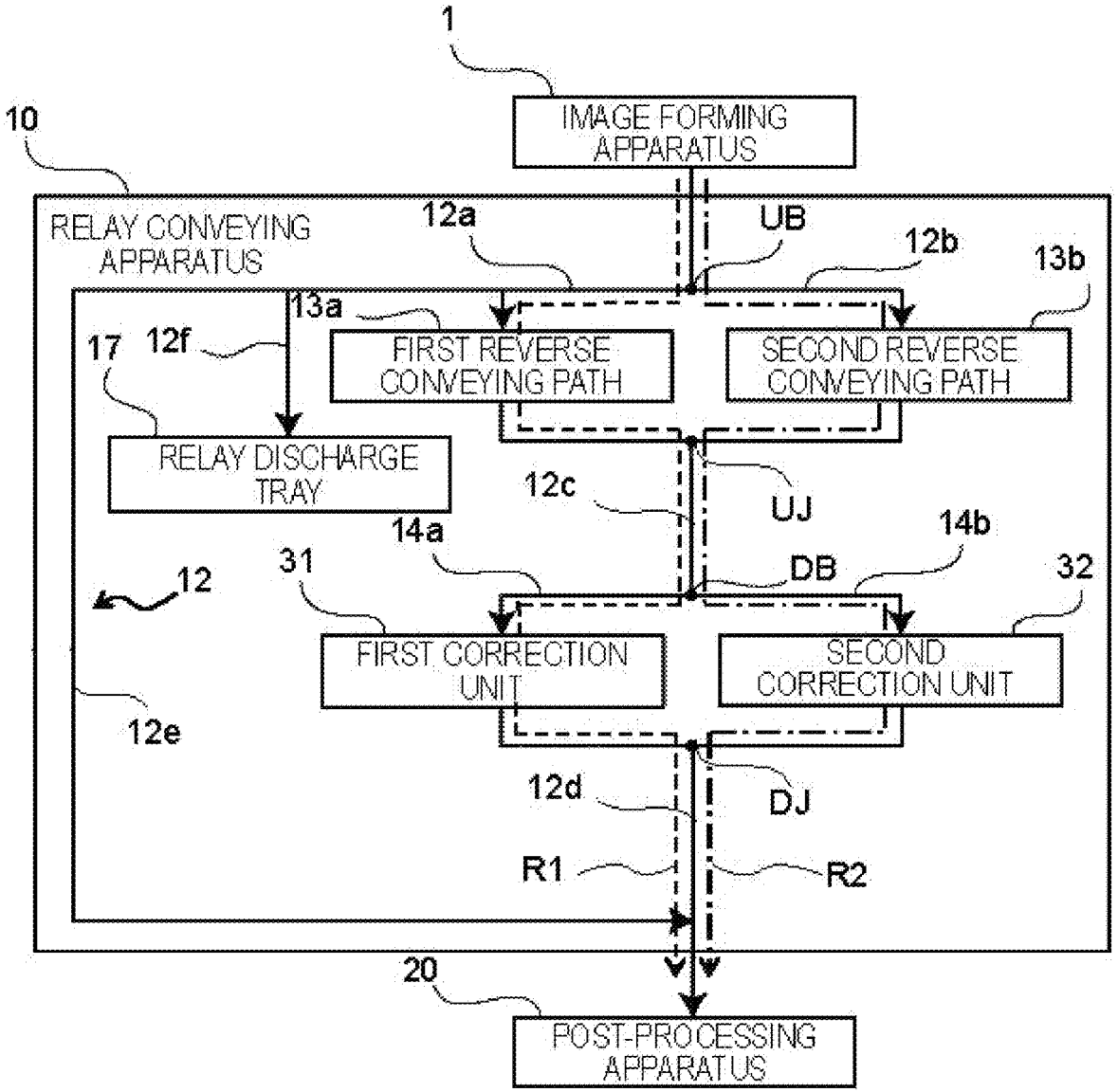
FIG. 2 is a block diagram illustrating sheet conveying paths in the image forming apparatus, the relay conveying apparatus, and the sheet post-processing apparatus.

Hereinafter, an embodiment of the present disclosure is described with reference to the drawings. FIG. 1 is a schematic drawing illustrating an internal structure of an image forming apparatus 1, a relay conveying apparatus 10, and a sheet post-processing apparatus 20 constituting an image forming system. FIG. 2 is a block diagram illustrating sheet conveying paths in the image forming apparatus 1, the relay conveying apparatus 10, and the sheet post-processing apparatus 20. With reference to FIGS. 1 and 2, there is described the image forming system constituted of the image forming apparatus 1, the relay conveying apparatus 10 as one example of a sheet conveying unit of the present disclosure, and the sheet post-processing apparatus 20.

The image forming apparatus 1 is an ink-jet recording printer, which includes a sheet storing unit 4 disposed at a lower part in the image forming apparatus 1, a sheet feeding unit 5 disposed at a side of the sheet storing unit 4 and above the same, an image recording unit 6 disposed above the sheet storing unit 4, and a reverse conveying unit 8 disposed above the image recording unit 6.

The sheet storing unit 4 includes a plurality of (three in this example) attachable and detachable sheet feed cassettes 4*a* on each of which paper sheets P are stacked and placed. The sheet feeding unit 5 feeds the paper sheets P stored in the sheet storing unit 4 to the image recording unit 6 using a sheet feed roller pair 5*a* disposed on a downstream side of each of the sheet feed cassettes 4*a* in a sheet conveying direction.

The image recording unit 6 is constituted of a print head 6*a* and a conveying unit 6*b* disposed to face the print head 6*a*. The conveying unit 6*b* includes an endless conveyor belt 7*a* stretched around a plurality of rollers including a drive roller. The conveyor belt 7*a* has many air suction holes (not shown). The paper sheet P fed out from the sheet feeding unit 5 passes below the print head 6*a*, in a state where it is sucked and held by the conveyor belt 7*a* with a sheet suction unit 7*b* disposed inside a loop of the conveyor belt 7*a*.

The print head 6*a* includes a plurality of ink-jet heads each of which ejects ink to the paper sheet P sucked and held to be conveyed by the conveyor belt 7*a*. The ink-jet heads are respectively supplied with four colors (cyan, magenta, yellow, and black) of ink, which are respectively stored in ink tanks (not shown).

When printing both sides of the paper sheet P, the reverse conveying unit 8 reverses an upside and a downside of the paper sheet P by switching the conveying direction (switchback) of the paper sheet P after one side thereof is printed. After that, the paper sheet P is conveyed to the image recording unit 7 again in a state where the non-recorded side of the paper sheet P faces upward. The paper sheet P on which predetermined images are recorded by the image recording unit 7 is discharged by a discharge roller pair 9 and enters the relay conveying apparatus 10.

The relay conveying apparatus 10 is disposed between the image forming apparatus 1 and the sheet post-processing apparatus 20, and conveys the paper sheet P discharged from the image forming apparatus 1 to the sheet post-processing apparatus 20. The relay conveying apparatus 10 performs a reversing process in which an upside and a downside of the paper sheet P on which images are recorded by the image forming apparatus 1 are reversed, and a drying process in which ink on the paper sheet P is dried. As illustrated in FIG. 1, the paper sheet P entering through a relay entrance 11 of the relay conveying apparatus 10 passes along a first conveying lane 12*a* and is conveyed to a first reverse conveying path 13*a* (reverse unit). After receiving the paper sheet P from the first conveying lane 12*a*, the first reverse conveying path 13*a* reverses an upside and a downside of the paper sheet P, by switching the conveying direction (switchback) in a first switchback branch part SB1.

Further, there is a second conveying lane 12*b* that branches from the first conveying lane 12*a* at an upstream side branch part UB, and the paper sheet P after passing along the second conveying lane 12*b* is conveyed to a second reverse conveying path 13*b* (reverse unit). After receiving the paper sheet P from the second conveying lane 12*b*, the second reverse conveying path 13*b* reverses an upside and a downside of the paper sheet P, by switching the conveying direction (switchback) in a second switchback branch part SB2.

The paper sheet P whose upside and downside are reversed by the first reverse conveying path 13*a* or the second reverse conveying path 13*b* joins a third conveying lane 12*c* at an upstream side junction part UJ. The paper sheet P is conveyed from the third conveying lane 12*c* to a first bypass conveying path 14*a* or a second bypass conveying path 14*b*, branching at a downstream side branch part DB. The first bypass conveying path 14*a* and the second bypass conveying path 14*b* include a first correction unit 31 and a second correction unit 32, respectively. The first correction unit 31 and the second correction unit 32 correct a position of the paper sheet P in a width direction (in a direction perpendicular to paper of FIG. 1).

The first bypass conveying path 14*a* and the second bypass conveying path 14*b* have the same distance from the downstream side branch part DB to paper sheet stop positions (horizontal parts in FIG. 1) as an conveying interval of the paper sheets P (an interval between paper sheets). Therefore, for example, by stopping a first paper sheet P reversed by the first reverse conveying path 13*a* in the second bypass conveying path 14*b*, and by stopping a second paper sheet P reversed by the second reverse conveying path 13*b* in the first bypass conveying path 14*a*, it is possible to convey again the paper sheets P in a state where the interval between paper sheets is maintained.

The paper sheets P after passing the first bypass conveying path 14*a* or the second bypass conveying path 14*b* join a fourth conveying lane 12*d* at a downstream side junction part DJ. The paper sheets P pass along the fourth conveying lane 12*d* and are discharged through a relay exit 16, so as to enter the sheet post-processing apparatus 20. Further, when sending the paper sheet P to the sheet post-processing apparatus 20 without the reversing process and without the position correction in the width direction, the paper sheets P passes along a fifth conveying lane 12*e* that branches from the first conveying lane 12*a* on the upstream side of the first reverse conveying path 13*a*, and is discharged through the relay exit 16. Furthermore, the paper sheet P that is not sent to the sheet post-processing apparatus 20 passes along a sixth conveying lane 12*f* that branches from the first conveying lane 12*a* and is discharged onto a relay discharge tray 17. The first conveying lane 12*a* to the sixth conveying lane 12*f* constitute a sheet conveying lane 12 that conveys the paper sheet P in the relay conveying apparatus 10.

Each of the first conveying lane 12*a*, the second conveying lane 12*b*, the first bypass conveying path 14*a*, and the second bypass conveying path 14*b* is provided with a fan 18 for blowing air to the paper sheet P so as to dry ink. Further, conveying roller pairs 19 (conveying members) for conveying the paper sheet P are disposed at appropriate positions in the first conveying lane 12*a* to the sixth conveying lane 12*f*, the first bypass conveying path 14*a*, and the second bypass conveying path 14*b*. Note that the passing route of the paper sheet P via the first reverse conveying path 13*a* and the first correction unit 31 (shown by a broken line in FIG. 2) is referred to as a first conveying path R1. Further, the passing route of the paper sheet P via the second reverse conveying path 13*b* and the second correction unit 32 (shown by a dashed dotted line in FIG. 2) is referred to as a second conveying path R2.

The sheet post-processing apparatus 20 is connected to the relay conveying apparatus 10 on the downstream side thereof in the conveying direction, and performs post-processing such as a punch hole forming process and/or a binding process on the paper sheet P on which images are recorded by the image forming apparatus 1 and after passing through the relay conveying apparatus 10.

As illustrated in FIG. 1, inside the sheet post-processing apparatus 20, there are disposed a punch hole forming device 22 that makes punch holes in the paper sheet P that enters through a paper sheet entrance 21, an end binding unit 23 that stacks a plurality of the paper sheets P, aligns ends of the paper sheets P to be a bundle, and stapling the bundle, and a saddle stitching and middle folding unit 25 that staples the paper sheets P at the middle and folds the same along the staple line to be a saddle stitch book. The side surface of the sheet post-processing apparatus 20 is provided with a main tray 24*a* that can move up and down to a position appropriate for receiving discharged paper sheets P, and a sub-tray 24*b* fixed to an upper part of the sheet post-processing apparatus 20.

The punch hole forming device 22 is disposed at an upper part in the sheet post-processing apparatus 20. The paper sheet P on which images are formed by the image forming apparatus 1 enters the sheet post-processing apparatus 20 through a paper sheet entrance 21 disposed at the upper right part thereof, and passes through the punch hole forming device 22. Then, if the stapling process is not to be performed, the paper sheet P is discharged as it is onto the sub-tray 24*b*. If the stapling process is to be performed, the paper sheet P is conveyed to the end binding unit 23 or the saddle stitching and middle folding unit 25 disposed below the punch hole forming device 22.

The end binding unit 23 is constituted of a stapler and a process tray (that are not shown), and the like. The paper sheets P stacked on the process tray are aligned at the front end and stapled at the end by the stapler disposed at the end of the process tray, and a bundle of the paper sheets P is discharged along the process tray onto the main tray 24*a*.

The saddle stitching and middle folding unit 25 disposed below the end binding unit 23 is constituted of a saddle stitching stapler, a middle folding device and a paper sheet guide (that are not shown), and the like. The saddle stitching stapler staples the center of the paper sheets P stacked in the paper sheet guide. A bundle of the paper sheets P stapled by the saddle stitching stapler is folded by the middle folding device along the staple line to be a saddle stitch book, and is discharged onto a book tray 26.

Figure 3:
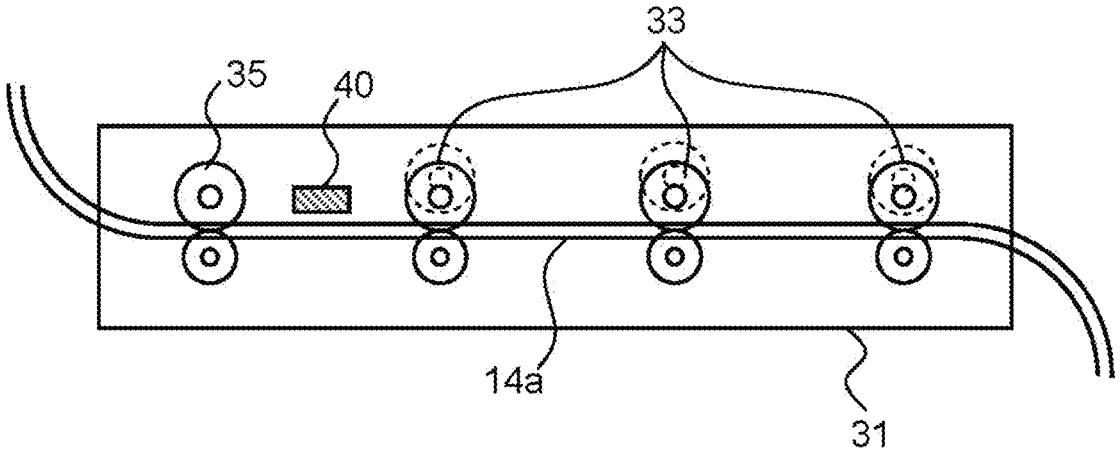
FIG. 3 is a cross-sectional side view schematically illustrating a first correction unit included in the relay conveying apparatus.

FIG. 3 is a cross-sectional side view schematically illustrating the first correction unit 31 in the relay conveying apparatus 10. Note that the second correction unit 32 has the same structure as the first correction unit 31, and hence only the first correction unit 31 is described below. The first correction unit 31 includes three switching roller pairs 33, a correcting roller pair 35 disposed on the downstream side of the switching roller pairs 33, and an edge detection sensor 40.

An upper side roller of the switching roller pair 33 can switch its position between a nip position (shown by a solid line in FIG. 3) for nipping the paper sheet P entering the first bypass conveying path 14*a* and a release position (shown by a broken line in FIG. 3) for releasing the paper sheet P. The correcting roller pair 35 can move in the width direction of the paper sheet P (in a direction perpendicular to paper of FIG. 3).

The edge detection sensor 40 is a photo interrupter (PI) sensor including a light emitting unit and a light receiving unit as a detection unit. The edge detection sensor 40 is disposed on the upstream side of the correcting roller pair 35 in the conveying direction of the paper sheet P, so as to detect an edge position of the paper sheet P in the width direction on the basis of a light intensity difference between a part that receives light from the light emitting unit and a part in which the light is blocked by the paper sheet P. In this way, a width direction position of the paper sheet P is detected.

A method of correcting the width direction position of the paper sheet P by the first correction unit 31 is described. When the paper sheet P is conveyed to the first bypass conveying path 14*a*, the edge detection sensor 40 first detects the width direction position of the paper sheet P. A detection result is sent to a control unit 70 (see FIG. 6).

Next, the switching roller pairs 33 and the correcting roller pair 35 are stopped in a state nipping the paper sheet P. Then, the upper side roller of each switching roller pair 33 is moved to the release position.

Next, the correcting roller pair 35 is moved in the width direction on the basis of the detection result of the edge detection sensor 40. For instance, if the width direction position of the paper sheet P is shifted from a reference position to the front of the relay conveying apparatus 10 (to the front side of paper of FIG. 3) by 1 mm, the correcting roller pair 35 is moved to the rear of the relay conveying apparatus 10 (to the backside of paper of FIG. 3) by 1 mm. After that, the upper side roller of each switching roller pair 33 is moved to the nip position, and rotation of the switching roller pairs 33 and the correcting roller pair 35 is restarted.

As described above, the relay conveying apparatus 10 includes the first reverse conveying path 13*a* and the second reverse conveying path 13*b* disposed in parallel, and the first correction unit 31 and the second correction unit 32 disposed in parallel, on the sheet conveying path. Further, the paper sheets P are conveyed alternately to the first reverse conveying path 13*a* or to the second reverse conveying path 13*b*. Thus, before one of the first reverse conveying path 13*a* and the second reverse conveying path 13*b* finishes the reversing operation of a first paper sheet P, the other of the first reverse conveying path 13*a* and the second reverse conveying path 13*b* can start the reversing operation of a second paper sheet P.

Similarly, the paper sheets P are conveyed alternately to the first correction unit 31 or to the second correction unit 32 disposed in parallel on the sheet conveying path. Thus, before one of the first correction unit 31 and the second correction unit 32 finishes the position correction of a first paper sheet P, the other of the first reverse conveying path 13*a* and the second reverse conveying path 13*b* can start the position correction of a second paper sheet P.

In this way, waiting time for reversing the paper sheet P and waiting time for position correction of the same can be shortened, so that a process efficiency of the paper sheets P by the relay conveying apparatus 10 (the number of sheets processed per unit time) can be enhanced.

Figure 4:
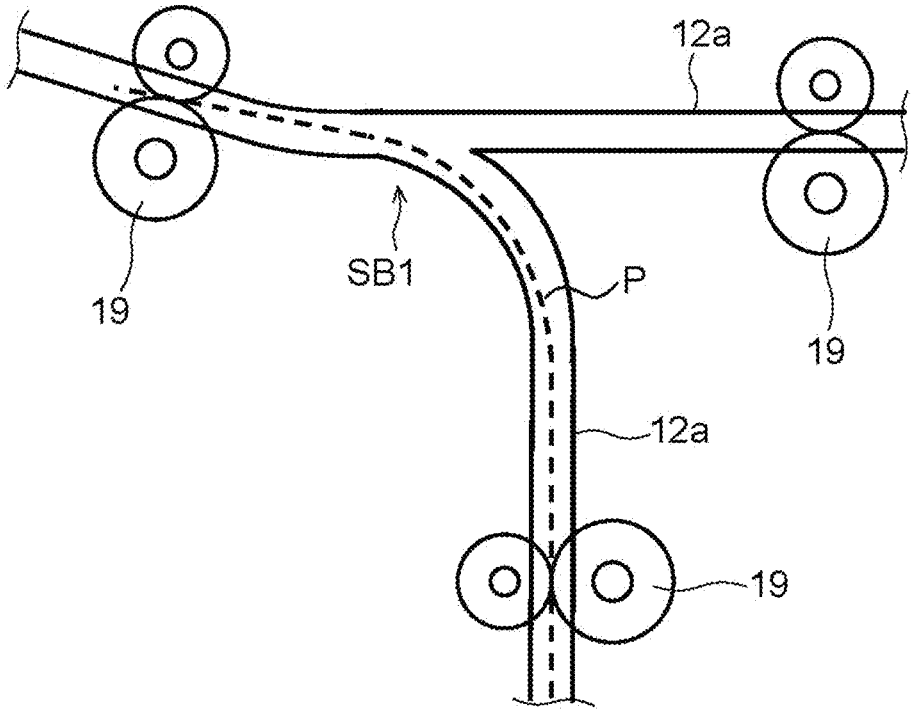
FIG. 4 is an enlarged view of a first switchback branch part and its vicinity in the relay conveying apparatus.

FIG. 4 is an enlarged view of the first switchback branch part SB1 and its vicinity in the relay conveying apparatus 10. As illustrated in FIG. 4, the first conveying lane 12*a* via the first reverse conveying path 13*a* is bent downward at the first switchback branch part SB1 by an angle larger than 90°, and joins the second conveying lane 12*b* at the upstream side junction part UJ (see FIG. 5). The paper sheet P reversed by the first reverse conveying path 13*a* is conveyed while moving and bending along the first switchback branch part SB1. Therefore, a conveying load for the paper sheet P via the first reverse conveying path 13*a* becomes maximum at the first switchback branch part SB1.

Figure 5:
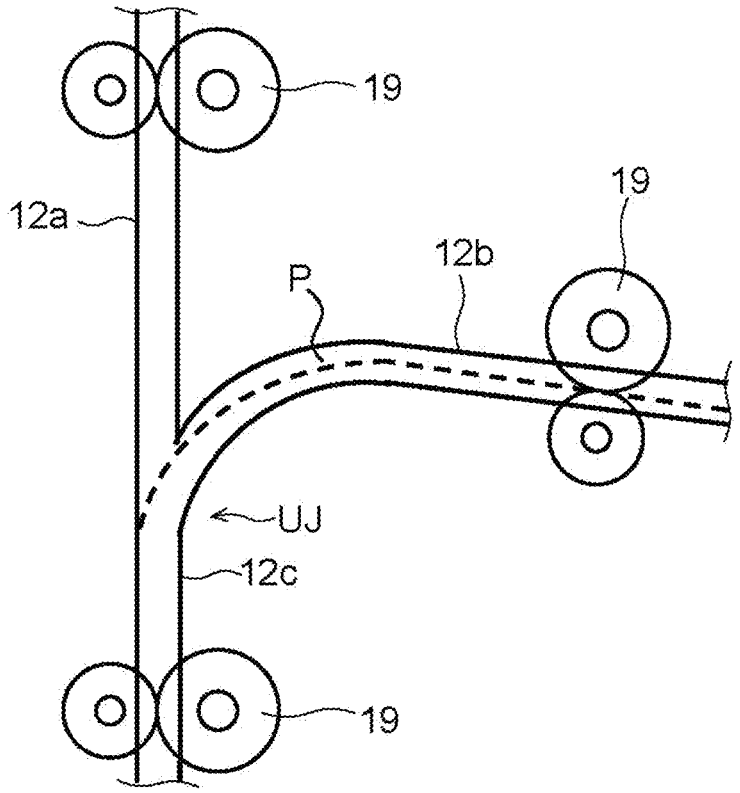
FIG. 5 is an enlarged view of an upstream side junction part and its vicinity in the relay conveying apparatus.

FIG. 5 is an enlarged view of the upstream side junction part UJ and its vicinity in the relay conveying apparatus 10. As illustrated in FIG. 5, the second conveying lane 12*b* via the second reverse conveying path 13*b* is bent downward by an angle smaller than 90°, and joins the first conveying lane 12*a* at the upstream side junction part UJ. The paper sheet P reversed by the second reverse conveying path 13*b* is conveyed while moving and bending along the upstream side junction part UJ. Therefore, a conveying load for the paper sheet P via the second reverse conveying path 13*b* becomes maximum at the upstream side junction part UJ.

In other words, the paper sheet P that is conveyed via the second reverse conveying path 13*b* is bent larger than the paper sheet P that is conveyed via the first reverse conveying path 13*a*. Therefore, the conveying load for the paper sheet P is larger for the paper sheet P that is reversed and conveyed by the second reverse conveying path 13*b* than the paper sheet P that is reversed and conveyed by the first reverse conveying path 13*a*.

Figure 6:
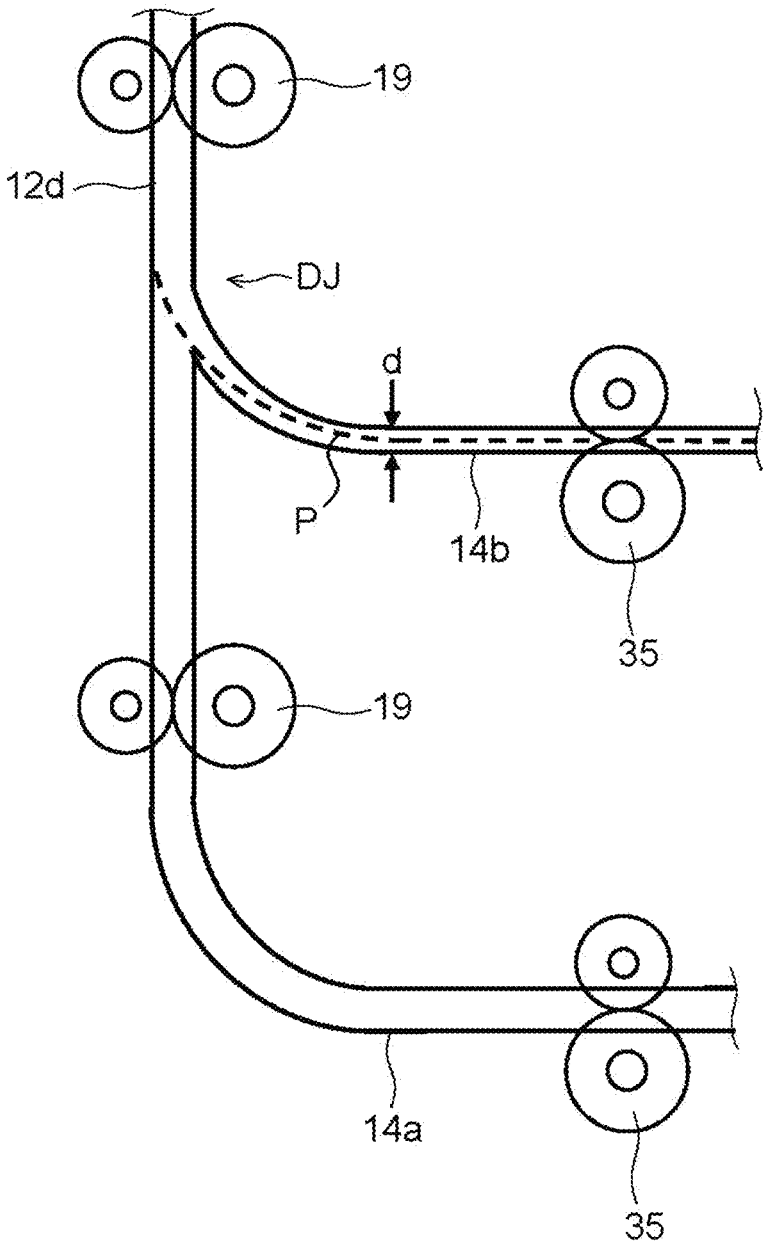
FIG. 6 is an enlarged view of a downstream side junction part and its vicinity in the relay conveying apparatus.

FIG. 6 is an enlarged view of the downstream side junction part DJ and its vicinity in the relay conveying apparatus 10. As illustrated in FIG. 6, the first bypass conveying path 14*a* equipped with the first correction unit 31 is bent upward by approximately 90° and is connected to the fourth conveying lane 12*d*. On the other hand, the second bypass conveying path 14*b* equipped with the second correction unit 32 is bent upward and joins the first bypass conveying path 14*a* at the downstream side junction part DJ.

If a clearance d of the second bypass conveying path 14*b* in a thickness direction of the paper sheet P is large, a passing position of the paper sheet P in the second bypass conveying path 14*b* is not stable, and the front end of the paper sheet P may abut the inside surface of the fourth conveying lane 12*d* at the downstream side junction part DJ, so that a paper fold may occur at the front end of the paper sheet P. Therefore, as illustrated in FIG. 6, the clearance d of the second bypass conveying path 14*b* is set smaller than that of the first bypass conveying path 14*a*. Therefore, the conveying load for the paper sheet P is larger when it is conveyed via the second bypass conveying path 14*b* than when it is conveyed via the first bypass conveying path 14*a*.

In particular, if the paper sheet P is a thick firm paper, the conveying load becomes large when it is conveyed in the second conveying path R2 via the second reverse conveying path 13*b* or the second bypass conveying path 14*b*, and hence paper jamming may occur at the upstream side junction part UJ or the downstream side junction part DJ.

Therefore, in the relay conveying apparatus 10 of this embodiment, if the paper sheet P entering through the relay entrance 11 is a thick paper, it can perform a thick paper conveying mode, in which the paper sheet P is conveyed using only the first conveying path R1 via the first reverse conveying path 13*a* and the first bypass conveying path 14*a*.

Figure 7:
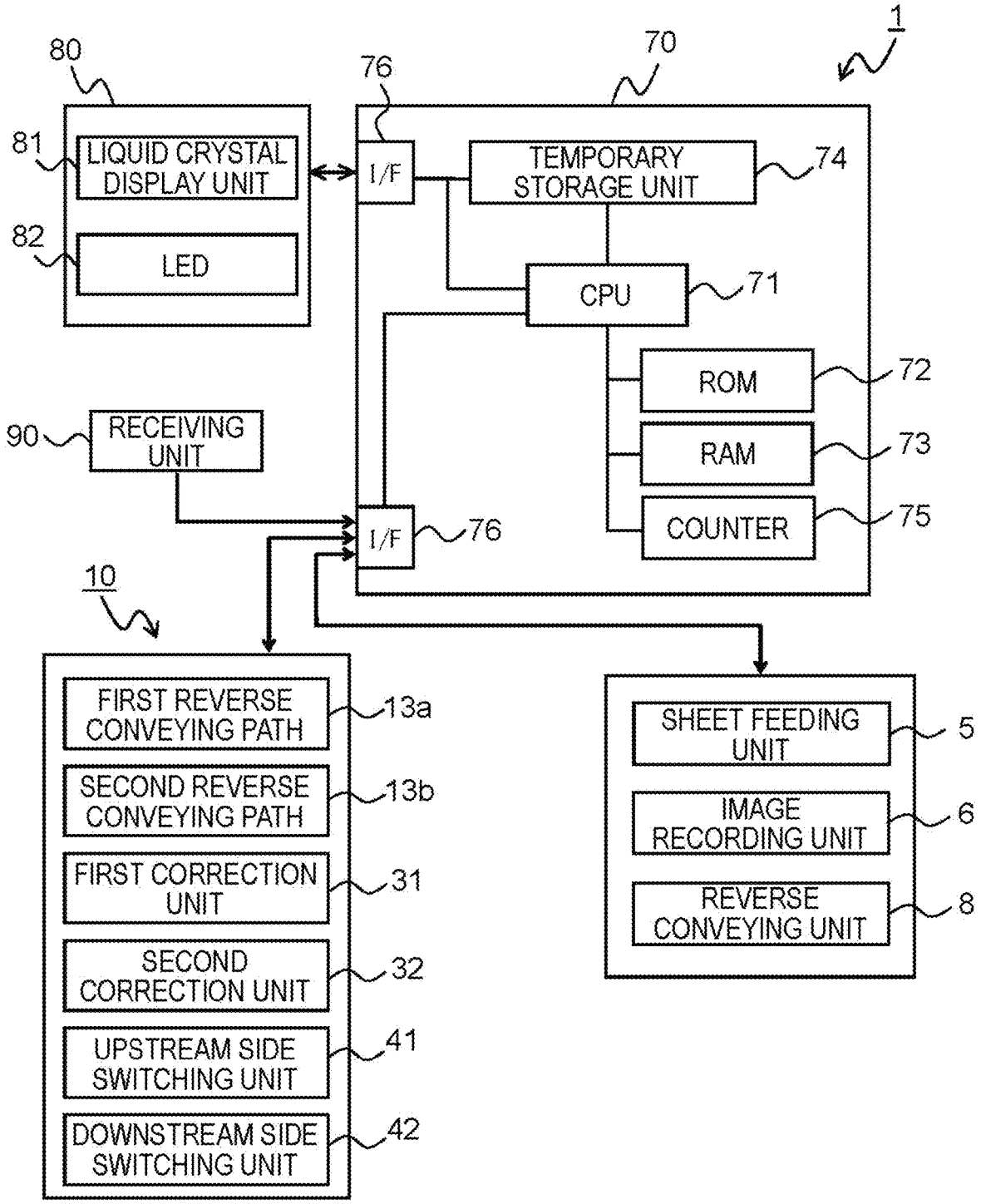
FIG. 7 is a block diagram illustrating a control path of the image forming system including the image forming apparatus and the relay conveying apparatus.

FIG. 7 is a block diagram illustrating a control path of the image forming system including the image forming apparatus 1 and the relay conveying apparatus 10. Note that, with reference to FIG. 7, in the control unit 70 and the relay conveying apparatus 10, a part necessary for implementing the present disclosure is mainly described. Further, in this description, the entire image forming system is controlled by the control unit 70 disposed in the image forming apparatus 1, but it may be possible to dispose the control unit 70 in the relay conveying apparatus 10.

An upstream side switching unit 41 is constituted of a branch guide or the like disposed at the upstream side branch part UB. The upstream side switching unit 41 switches the conveying path of the paper sheet P entering through the relay entrance 11 between the first conveying lane 12*a* and the second conveying lane 12*b*, on the basis of a control signal from the control unit 70.

A downstream side switching unit 42 is constituted of a branch guide or the like disposed at the downstream side branch part DB. The downstream side switching unit 42 switches the conveying path of the paper sheet P after passing the third conveying lane 12*c* between the first bypass conveying path 14*a* and the second bypass conveying path 14*b*, on the basis of a control signal from the control unit 70.

The control unit 70 includes at least a central processing unit (CPU) 71, a read only memory (ROM) 72 as a storage unit that is dedicated for reading, a random access memory (RAM) 73 as a storage unit that can read and write, a temporary storage unit 74 that temporarily stores image data and the like, a counter 75, and a plurality of (two, in this example) interfaces (I/Fs) 76.

The ROM 72 stores a program for system control, numeric values and the like necessary for the control, and data and the like that are not changed. The RAM 73 stores necessary data generated in the system control, and data or the like that is temporarily necessary for the control. Further, the ROM 72 (or the RAM 73) also stores the conveying intervals of the paper sheet P in a case where the paper sheets P are plane paper sheets (first sheets) and in a case where the paper sheets P are thick paper sheets (second sheets).

The counter 75 counts the number of printed sheets in the image forming apparatus 1, and counts the number of paper sheets P conveyed from the image forming apparatus 1 to the relay conveying apparatus 10. Note that instead of providing the counter 75 separately, it may be possible to store the number in the RAM 73, for example.

Further, the control unit 70 sends control signals from the CPU 71 via the I/F 76 to individual units and devices in the system including the image forming apparatus 1 and the relay conveying apparatus 10. Further, each of the individual units and devices sends to the CPU 71 a signal indicating its status and an input signal via the I/F 76. The individual units and devices controlled by the control unit 70 include, for example, the sheet feeding unit 5, the paper sheet conveying unit 6, the image recording unit 7, and the reverse conveying unit 8 in the image forming apparatus 1, and the first reverse conveying path 13*a*, the second reverse conveying path 13*b*, the first correction unit 31, the second correction unit 32, the upstream side switching unit 41, and the downstream side switching unit 42 in the relay conveying apparatus 10. Note that the control unit 70 constitutes a sheet conveying apparatus of the present disclosure together with the relay conveying apparatus 10.

An operation unit 80 includes a liquid crystal display unit 81, and an LED 82 indicating various statuses. A user operates the operation unit 80 so as to input instructions, and thus the user makes various setting for the image forming apparatus 1 and the sheet post-processing apparatus 20, and allows them to perform various functions such as an image forming function and a post-processing function. The liquid crystal display unit 81 displays a status of the system, an image forming status, and the number of printed sheets, and also functions as a touch panel for setting functions such as double-sided printing, black and white inversion, scale setting, and density setting.

A receiving unit 90 receives, from a host device such as a personal computer, information about a print command, a print image, the paper sheet P, and the like. The received information is sent to the control unit 70.

Figure 8:
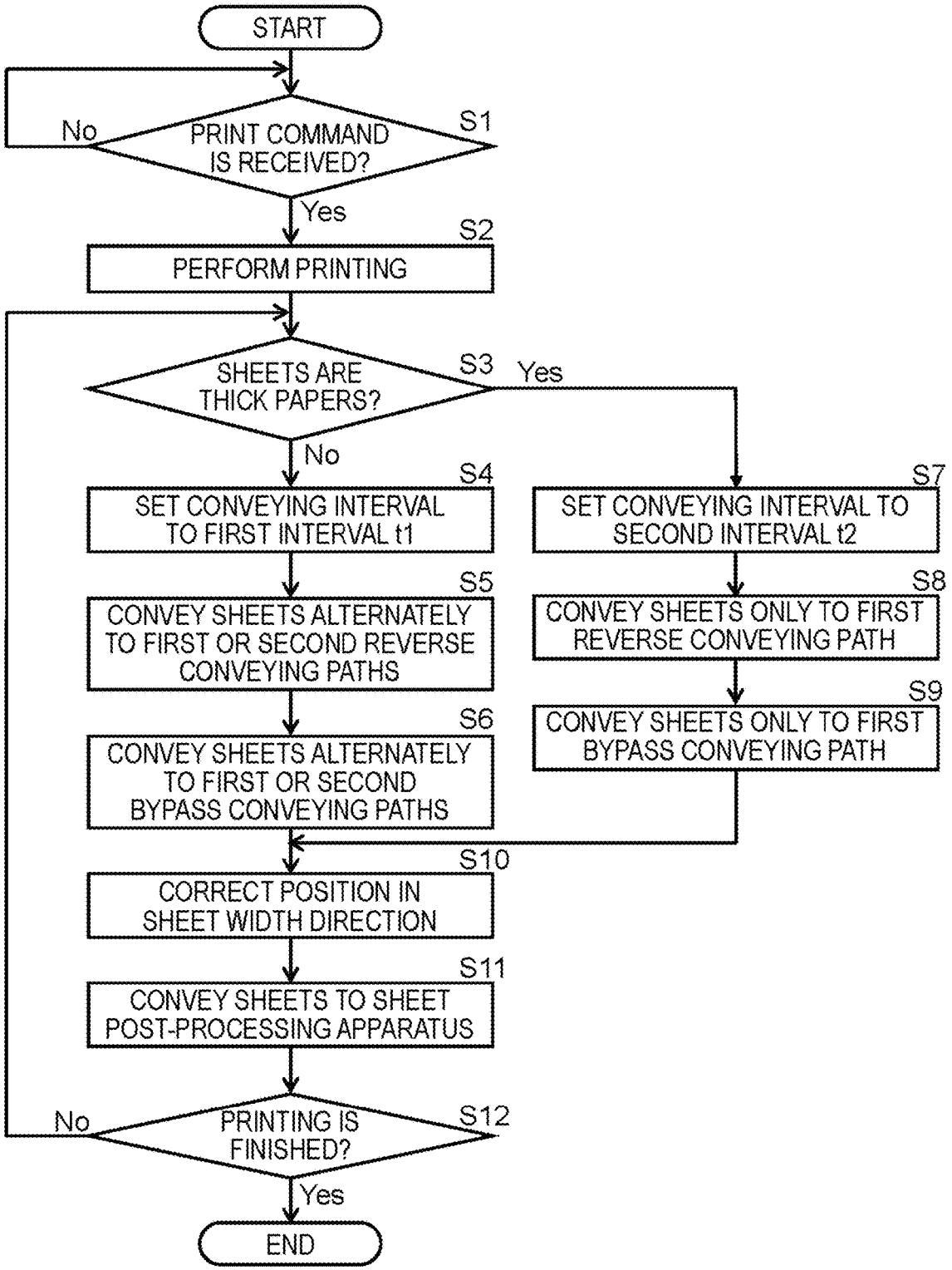
FIG. 8 is a flowchart illustrating one example of sheet conveying control in the relay conveying apparatus.

FIG. 8 is a flowchart illustrating one example of sheet conveying control in the relay conveying apparatus 10 of the present disclosure. With reference to FIGS. 1 to 7, and along the steps shown in FIG. 8, a procedure of conveying paper sheets in the relay conveying apparatus 10 is described.

The control unit 70 determines whether or not the receiving unit 90 has received a print command from a personal computer (operation terminal) (Step S1). If the print command is received (Yes in Step S1), the image forming apparatus 1 performs printing (Step S2). The paper sheet P after printing is conveyed to the relay conveying apparatus 10.

Next, the control unit 70 determines whether or not the paper sheets P are plane paper sheets or thick paper sheets on the basis of the information about the paper sheet P included in the print command (Step S3). If the paper sheets P are plane paper sheets (No in Step S3), the conveying interval of the paper sheets P is set to a first interval t1 (Step S4). Further, the upstream side switching unit 41 is switched every time when the paper sheet P passes through the upstream side branch part UB, so that the paper sheets P enter alternately the first reverse conveying path 13*a* or the second reverse conveying path 13*b* (Step S5). In addition, the downstream side switching unit 42 is switched every time when the paper sheet P passes through the downstream side branch part DB, so that the paper sheets P enter alternately the first bypass conveying path 14*a* or the second bypass conveying path 14*b* (Step S6).

On the other hand, if the paper sheets P are thick paper sheets (Yes in Step S3), the conveying interval of the paper sheets P is set to a second interval t2 (t2>t1) (Step S7). Further, without switching the upstream side switching unit 41, the paper sheets P are conveyed only to the first reverse conveying path 13*a* (Step S8). In addition, without switching the downstream side switching unit 42, the paper sheets P are conveyed only to the first bypass conveying path 14*a* (Step S9).

Next, the width direction position of the paper sheet P is detected by the edge detection sensor 40 (see FIG. 3) in the first correction unit 31 or the second correction unit 32, and on the basis of a detection result, the width direction position of the paper sheet P is corrected (Step S10). The paper sheet P after the position correction is conveyed to the sheet post-processing apparatus 20 (Step S11). After that, the control unit 70 determines whether or not printing is finished in the image forming apparatus 1 (Step S12). If the printing is continued (No in Step S12), the process flow returns to Step S3, and the conveying control of the paper sheets P is repeated (Steps S3 to S12). If the printing is finished (Yes in Step S12), the process is finished.

With the control described above, if the paper sheets P, which are conveyed from the image forming apparatus 1 to the relay conveying apparatus 10, are thick paper sheets, the thick paper conveying mode is performed, in which the first conveying path R1 including the first reverse conveying path 13*a* and the first bypass conveying path 14*a* is fixedly used for conveying. In this way, if the paper sheets P are thick paper sheet, it is possible to avoid passing along the second reverse conveying path 13*b* that may cause paper jamming at the upstream side junction part UJ (see FIG. 5) or passing along the second bypass conveying path 14*b* that may cause paper jamming at the downstream side junction part DJ (see FIG. 6).

Therefore, it is possible to avoid paper jamming when conveying thick paper sheets using the relay conveying apparatus 10. Further, with the simple control of switching the conveying path in accordance with a type of the paper sheets P, it is possible to reverse an upside and a downside of the paper sheets P, and to perform position correction in the width direction thereof, smoothly without changing a layout of the conveying path or a shape of a component.

However, if the paper sheets P are thick paper sheets, only the first conveying path R1 including the first reverse conveying path 13*a* and the first bypass conveying path 14*a* is used for conveying, and hence it is necessary to increase the conveying interval to be larger than that in the case of plane paper sheets, in which the paper sheets P are conveyed alternately to the first conveying path R1 or to the second conveying path R2. Therefore, the process efficiency of the paper sheets P by the relay conveying apparatus 10 is decreased from the case of plane paper sheets.

Other than that, the present disclosure is not limited to the embodiment described above but can be variously modified within the scope of the present disclosure without deviating from the spirit thereof. For instance, the above embodiment describes the example in which the present disclosure is applied to the relay conveying apparatus 10 connected to the image forming apparatus 1, but for example, the present disclosure can be applied similarly to a case where the image forming apparatus 1 or the sheet post-processing apparatus 20 include two parallel conveying paths each of which includes a reverse tray and a correction unit, and the conveying paths have different conveying loads.

Further, in the above embodiment, it is determined whether or not the paper sheets P are thick paper sheets on the basis of information about the paper sheet received by the receiving unit 90 from the personal computer or the like, it may be possible to input thickness information of the paper sheets P on the operation unit 80. Alternatively, it may be possible to provide a thickness detection sensor (not shown) for detecting thickness of the paper sheets P, and the control unit 70 may determine whether or not the paper sheets P are thick paper sheets, on the basis of a detection result by the thickness detection sensor (thickness information of the paper sheets P). As the thickness detection sensor, a well-known media sensor can be used. In the above cases, the operation unit 80 or the thickness detection sensor corresponds to the receiving unit for receiving the thickness information of the paper sheets P.

In addition, in the above embodiment, an ink-jet printer is exemplified as the image forming apparatus 1, but it is needless to say that the image forming apparatus 1 may be an apparatus other than the ink-jet printer, such as a copier, a laser printer, or a facsimile machine.

The present disclosure can be applied to a sheet conveying unit for conveying sheets. Using the present disclosure, it is possible to provide a sheet conveying unit that can perform the conveying operation smoothly in a case where the sheets are thick paper sheets, without changing a layout of the conveying path or a shape of a component in a structure including two parallel conveying paths.

What is claimed is:

1. A sheet conveying apparatus comprising:

a sheet conveying path including a first conveying path, and a second conveying path that is disposed in parallel to each other, the second conveying path having a conveying load for a sheet larger than the first conveying path;

conveying members disposed along the sheet conveying path so as to convey the sheet;

a switching unit disposed at a branch part of the first conveying path and the second conveying path so as to selectively switch the sheet conveying path between the first conveying path and the second conveying path;

a receiving unit configured to receive sheet thickness information; and a control unit configured to control the conveying members and the switching unit on the basis of the sheet thickness information, wherein the control unit determines whether the sheet is a first sheet or a second sheet thicker than the first sheet on the basis of the sheet thickness information, when conveying the first sheets, the control unit controls the switching unit to switch the sheet conveying path between the first conveying path and the second conveying path alternately for every sheet, and when conveying the second sheets, the control unit controls the switching unit to fix the sheet conveying path to the first conveying path.

2. The sheet conveying apparatus according to claim 1, wherein a conveying interval of the second sheets is set larger than the conveying interval of the first sheets.

3. The sheet conveying apparatus according to claim 1, wherein the first conveying path and the second conveying path respectively includes a first reverse unit and a second reverse unit, each of which performs switchback of the sheet so as to reverse an upside and a downside thereof, and a curvature of a first switchback branch part of the first reverse unit is smaller than a curvature of a second switchback branch part of the second reverse unit, the conveying load in the curvature of the second switchback branch part is heavier than in the curvature of the first switchback branch part.

4. The sheet conveying apparatus according to claim 1, wherein the first conveying path and the second conveying path respectively include a first correction unit and a second correction unit, each of which moves the sheet in a width direction perpendicular to a sheet conveying direction so as to correct a width direction position of the sheet, and a curvature of a first bypass conveying path via the first correction unit is smaller than a curvature of a second bypass conveying path via the second correction unit, the conveying load in the curvature of the second bypass conveying path is heavier than in the curvature of the first bypass conveying pass.

5. The sheet conveying apparatus according to claim 1, wherein the second conveying path has a curvature larger than the first conveying path.

6. The sheet conveying apparatus according to claim 1, wherein the second conveying path has a smaller clearance in a sheet thickness direction than the first conveying path.

7. An image forming system comprising:

the sheet conveying apparatus according to claim 1; and an image forming apparatus forming an image on the sheet, which is connected to the sheet conveying apparatus on an upstream side thereof in a sheet conveying direction so as to discharge the sheet formed the image to the sheet conveying apparatus.

8. The image forming system according to claim 7, further comprising a sheet post-processing apparatus connected to the sheet conveying apparatus on a downstream side thereof in the sheet conveying direction so as to perform predetermined post-processing on the sheet conveyed by the sheet conveying apparatus.

* * * * *